US010359159B2

(12) United States Patent
Baxter et al.

(10) Patent No.: US 10,359,159 B2
(45) **Date of Patent: *Jul. 23, 2019**

(54) LIQUID COOLED VENUE LIGHT

(71) Applicant: Sportsbeams Lighting, Inc., Plano, TX (US)

(72) Inventors: Kevin C. Baxter, Glendale, CA (US); Fred H. Holmes, Plano, TX (US)

(73) Assignee: Sportsbeam Lighting, Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/668,872

(22) Filed: Aug. 4, 2017

(65) Prior Publication Data

US 2018/0045386 A1 Feb. 15, 2018

Related U.S. Application Data

(63) Continuation of application No. 13/441,831, filed on Apr. 6, 2012, now Pat. No. 9,752,738.

(Continued)

(51) Int. Cl.

| | |
|---|---|
| ***F21V 29/00*** | (2015.01) |
| ***F21L 4/02*** | (2006.01) |
| ***F21V 7/00*** | (2006.01) |
| ***F21V 29/56*** | (2015.01) |
| ***F21S 8/00*** | (2006.01) |

(Continued)

(52) U.S. Cl.

CPC ..... *F21L 4/02* (2013.01); *F21S 8/003* (2013.01); *F21V 7/00* (2013.01); *F21V 7/0008* (2013.01); *F21V 7/06* (2013.01); *F21V 29/402* (2013.01); *F21V 29/56* (2015.01); *F21V 7/22* (2013.01); *F21V 21/30* (2013.01); *F21V 29/70* (2015.01); *F21W 2131/107* (2013.01);

(Continued)

(58) Field of Classification Search

CPC ..... F21L 4/02; F21S 8/003; F21V 7/0008; F21V 29/402

See application file for complete search history.

(56) References Cited

U.S. PATENT DOCUMENTS 5,895,128 A * 4/1999 Kishimoto ..... G03B 15/05 396/182
6,623,144 B2 * 9/2003 Bornhorst ..... F21S 10/007 348/E5.141

(Continued)

OTHER PUBLICATIONS https://en.wikipedia.org/wiki/Searchlight.

*Primary Examiner* — Tracie Y Green
(74) *Attorney, Agent, or Firm* — Scott R. Zingerman

(57) ABSTRACT

LED based searchlight/sky light including, in a basic embodiment, a housing; an LED array supported in/by the housing, a heat sink in communication with the LED array, and a reflector supported in the housing such that the LED array is supported by the housing a distance sufficient above the reflector to allow the light emitted by the LED array to be reflected by the reflector. The reflector is preferably a parabolic reflector such that the light emitted by the LED array is reflected by the parabolic reflector in an intense collimated beam. The LED array may be supported above the parabolic reflector a distance equal to the focal length of the parabolic reflector. A power supply may also be included to regulate the electrical current applied to the LED array.

20 Claims, 3 Drawing Sheets

Related U.S. Application Data

(60) Provisional application No. 61/472,532, filed on Apr. 6, 2011.

(51) Int. Cl.

| | |
|---|---|
| ***F21V 7/06*** | (2006.01) |
| *F21V 7/22* | (2018.01) |
| *F21V 21/30* | (2006.01) |
| *F21W 131/107* | (2006.01) |
| *F21V 29/70* | (2015.01) |
| *F21Y 105/10* | (2016.01) |
| *F21Y 115/10* | (2016.01) |
| *F21Y 113/13* | (2016.01) |

(52) U.S. Cl.
CPC ..... *F21Y 2105/10* (2016.08); *F21Y 2113/13* (2016.08); *F21Y 2115/10* (2016.08)

(56) References Cited

U.S. PATENT DOCUMENTS 6,749,310 B2 * 6/2004 Pohlert ..... G03B 15/02 348/E5.029
6,824,283 B2 11/2004 Pohlert et al.
6,948,823 B2 9/2005 Pohlert et al.
7,140,742 B2 11/2006 Pohlert et al.
7,163,302 B2 1/2007 Pohlert et al.
7,178,937 B2 * 2/2007 McDermott ..... F21V 7/0008 362/187
7,314,291 B2 * 1/2008 Tain ..... F21K 9/00 257/99
7,318,652 B2 1/2008 Pohlert et al.
7,331,681 B2 * 2/2008 Pohlert ..... F21V 14/06 348/E5.029
7,429,117 B2 * 9/2008 Pohlert ..... H04N 5/2354 348/E5.029
7,510,290 B2 3/2009 Pohlert et al.
7,604,361 B2 10/2009 Pohlert et al.
7,798,667 B2 * 9/2010 Klipstein ..... B60Q 1/0483 250/504 H
7,874,701 B2 1/2011 Pohlert et al.
7,902,761 B2 * 3/2011 Ang ..... H05B 33/0815 315/194
7,972,022 B2 7/2011 Pohlert et al.
8,025,417 B2 9/2011 Pohlert et al.
8,506,125 B2 8/2013 Pohlert et al.
8,540,383 B2 9/2013 Pohlert et al.
8,702,255 B2 * 4/2014 Baxter ..... F21V 29/673 362/268
8,882,283 B2 11/2014 Baxter et al.
2005/0128752 A1 * 6/2005 Ewington ..... F21V 29/004 362/294
2007/0253188 A1 * 11/2007 Klipstein ..... A61B 1/128 362/105
2008/0175008 A1 * 7/2008 Hu ..... F21K 9/00 362/373
2009/0059594 A1 * 3/2009 Lin ..... F21K 9/00 362/294
2010/0204841 A1 * 8/2010 Chemel ..... F21V 29/02 700/282

* cited by examiner

LIQUID COOLED VENUE LIGHT

CROSS REFERENCE TO RELATED APPLICATION

This application is a continuation of co-pending U.S. application Ser. No. 13/441,831, filed Apr. 6, 2012, which claims the benefit of U.S. Provisional Patent Application Ser. No. 61/472,532, filed on Apr. 6, 2011, herein incorporated by reference in its entirety for all purposes.

FIELD OF THE INVENTION

This invention relates to searchlights, also known as sky lights commonly used in the advertising industry.

BACKGROUND OF THE INVENTION

Searchlights, also commonly called sky lights, have historically been based on carbon arc or more recently xenon short arc bulbs as the light source. A dense amount of light in a very small area is considered a point source and this coupled with a parabolic mirror allow searchlights to provide an intense projected beam of light. To the present, carbon arcs and xenon short arc lamps have been considered the best existing point sources of light. However, these light sources require large amounts of power, emit large amounts of infrared (IR) and ultraviolet (UV), have a short bulb life, and are not completely stable in their operation. These fixtures use deep parabolic mirrors that reflect the emitted light into a highly collimated beam that under ideal atmospheric conditions appear as tight beams which can be seen for miles.

Several, and usually four, of these fixtures are mounted on a platform which spins and the light's vertical direction is simultaneously tipped up and down. This type of movement projects moving, dancing, sweeping beams of light through the sky, attracting the attention of the public, and drawing them to the source of the beams, in essence an advertising method.

These moving platforms of light require substantial amounts of electricity in order to operate as each light fixture uses between 2,000 and 4,000 watts of electricity. When a group of 4 lights are used and the motors and power supplies are included, the power draw can easily exceed 100 amps and most business either don't have that much excess power or it is not available at the location that the lights must be positioned, such as on a roof. This large power demand requires a generator to also be provided, along with the fuel and an operator, to keep it all fueled and running. It can be a very expensive proposition. A need exists for a searchlight which requires substantially less electricity such that a generator and dedicated operator are not necessary.

There are additional issues such as the bulbs themselves. When they burn out, the service technician must wear protective gear to shield themselves during the re-bulbing process from flying quartz glass as the bulbs, especially when hot, have enormous pressures inside. The bulbs have a life from 200-1000 hours but rarely longer and they can be very expensive depending on their size. The technician usually wears leather wrist covers, a leather chest protector and a face shield over safety goggles whenever he handles one. The bulbs also sometimes explode when being used, destroying not just themselves but a very expensive reflector and the cover glass. Quartz glass shards are nearly invisible when impaled into the human body and consequently are very hard to find often requiring them to be removed by surgeons in a hospital setting. The cover glass in current designs is safety glass and also has UV absorbing properties to protect the public and operator from excessive UV exposure.

The bulb's life decreases and the risk of explosion increases if a careless technician were to accidently touch one with a bare finger wherein the finger oil reacts on the glass when the bulb heats up. The bulbs must also be blasted by a powerful amount of moving cool air and that air exhausted in order to keep the bulbs from melting or exploding. They can do either or both if the fan fails or isn't run long enough after the bulb is turned off such as when a generator unexpectedly fails. These bulbs also suffer from an instable arc which appears as flicker though this is usually just the arc jumping around and not being stable, but the unwanted effect from the defocusing act of this jumping appears to the observer as going on and off rapidly.

The parabolic reflectors used in present searchlights/sky lights are highly reflective mirrors plated onto a nickel metal shape. The process of making these types of mirrors is a long and arduous process using large quantities of nickel, electricity, and vacuum chambers for depositing the nickel to form the highly reflective mirror like surface. This process is well known in the art but the simple fact is that these mirrors are very expensive and their finish is very delicate and easy to damage, even by simple mishandling such as touching them with bare fingers. In the case of searchlights, the reflectors are more complicated in some aspects as they have to be very deep because the light emitted from the xenon bulbs is omni-directional. That is to say that the light comes out at nearly 360 degrees, on all axes, and that light must all then be directed in a single direction with the aid of the reflector.

The reflectors also have to be able to reflect heat and not just the light out of the fixture in the light beam using such technology as in a cold mirror which is mostly made by using specially and expensively applied layers of reflector material in the vacuum chamber process or a traditional hot mirror where the mirror and the nickel absorb a great deal of the heat so it is not transmitted in the light beam. Xenon beams have been known to burn people by the projected IR waves and to start many fires because their beams are so intense. The hot mirrors also have to be cooled by powerful fans in order to remove the intense heat from the fixture.

These reflectors are generally sized by two parameters, total wattage and arc size. The greater the power of the light, the more surface area of mirror is required because a mirror can only absorb or reflect so much IR before it heats up to the point where the surface materials degrade. There is also the issue of point source size vs. focal length. A large source requires a much longer focal length, and the reflector then would require a much larger outside diameter. This increased size exponentially increases the cost of the mold, nickel, and fabrication costs in general so it is best to minimize the point source size to minimize the reflector size requirements. Deep reflectors also cost much more than shallow reflectors but yet they capture a larger angle of emitted light than the shallow versions, a trade-off situation.

The primary function of these searchlights/sky lights is to attract attention and occasionally operators are asked to add colored filters to increase the attention further. The hot light from these arc sources generally fade the filter material in a matter of hours or worse yet melt them beyond usability.

What is needed is new point source light that does not have the requirements of high power usage, short life, does not emit UV, IR, risk explosions, require safety clothing, sensitive handling, powerful cooling fans, deep reflectors, or high cost.

SUMMARY OF THE INVENTION

The device of the present disclosure uses at least one high flux LED and preferably a plurality of high flux LEDs arranged in an array such that the light emitted is directed toward a reflector. The array could be of any suitable geometry and includes a suitable number of LEDs to the power requirements. The array of LEDs is positioned with respect to the reflector so as to focus the individual beams of light emitted from the individual LED's into a single intense column of light suitable for projection by a searchlight/sky light application. These LEDs can be clustered in a tight group. It is preferred to employ a cluster of high flux LEDs to at least double the amount of light as a xenon bulb consuming the same power. LEDs emit no UV and an extremely small amount of IR.

The LED based searchlight/sky light of the present disclosure includes, in a basic embodiment, a housing; an LED array supported in/by the housing, a heat sink in communication with the LED array, and a reflector supported in the housing such that the LED array is supported by the housing a distance sufficient above the reflector to allow the light emitted by the LED array to be reflected by the reflector. The reflector is preferably a parabolic reflector such that the light emitted by the LED array is reflected by the parabolic reflector in a collimated beam. In other words, the LED array is preferably supported above the parabolic reflector by a distance equal to the focal length of the parabolic reflector.

It is contemplated that the device of the present disclosure may use a heatsink on this highly concentrated array of high density LEDs. It is further contemplated that this heatsink would have to be actively cooled by forced air, heat pipes, or liquid cooled, with liquid cooling being the preferred method. This may best be accomplished by a liquid which is a water/glycol mixture circulated through a jacket or manifold and then to a radiator or other such heat exchange apparatus that would in turn be fan cooled. The liquid mixture used for cooling may be moved (circulated) by a small pump. A radiator could be either in the fixture head itself or somewhat removed nearby for heat exchange.

The expensive parabolic mirror of present designs would ideally be replaced with a reflector made of relatively inexpensive plastic with an applied mirror finish so as to reduce costs, weight, and would be much easier to replace and recycle than the present nickel/aluminum versions. The LED arrays would preferably have integral lenses so that they would project light in a 120 degree cone, not omnidirectionally, allowing a much shallower reflector with little waste of light. The safety glass which was previously quite fragile could be replaced with a sheet of polycarbonate, sometimes called bullet proof glass or other suitable material.

The fixtures of the present disclosure could be mounted on moving arms and in groups to provide lighting effects similar to those used with present short arc lamps but without all of the hazards and negatives referenced above with regard to existing constructions. The LEDs could be driven with constant current to protect them from over current situations or brightness changes caused by the LED's forward voltage changing due to LED temperature changes, a physical reality. This inventive power process would also protect the LED arrays from voltage spikes when powered from unstable generators or AC power.

The lights of the present disclosure could be able to be controlled manually or remotely by such methods as DMX-512, an industry standard, or by wireless, or by a connection through the Internet. Internet based controls would allow feedback regarding the internal conditions of the light which the other methods might or might not need to provide. The LEDs are preferably white but in alternate embodiments be replaced with red, green, or blue (RGB). These bright RGB colors could provide the color effects but will not fade as filters do with traditional light sources.

The light of the present disclosure might also use light shaping diffusion (LSD) which is a holographic type film that can change the shape of the light to best conform to the shape of an object such as a building and not allow significant light spill into the sky. This feature would allow the inventive light to best conform to "dark skies" initiatives. This LSD would be unique to the industry because most architectural lighting is simply too hot and would melt the LSD when applied during use. The tight group (array) of clustered high flux LEDs could also be arranged into an elongated pattern rather than a circular shape to allow the shape of the light emitted from the present system to be elongated in such a way as to best match the shape of a desired object, such as a building's outline, without using LSD.

Other aspects and advantages of the invention will be apparent from the following description and the appended claims.

DETAILED DESCRIPTION OF THE PREFERRED EMBODIMENT

Figure 1:
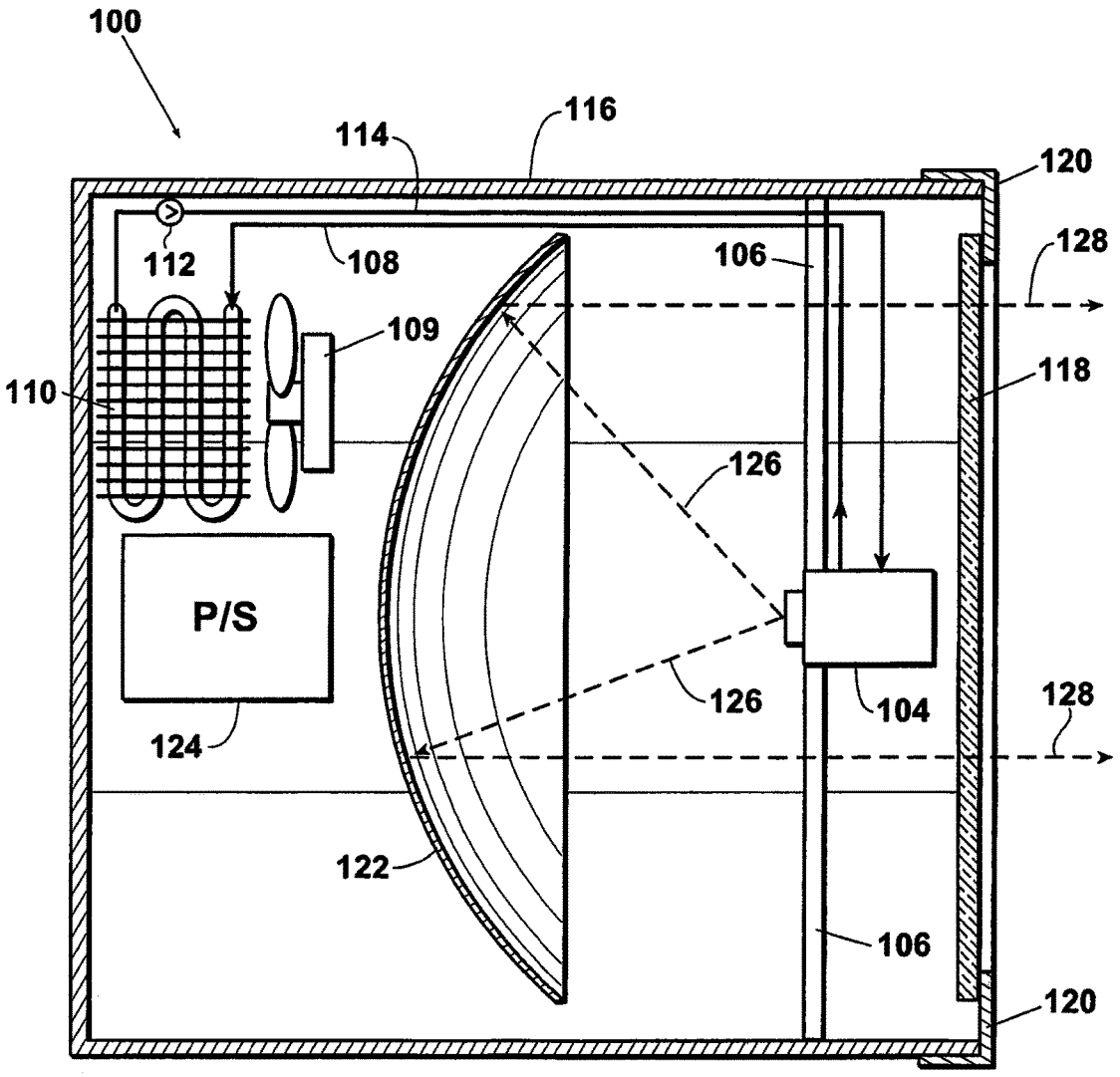
FIG. 1 is a top cutaway view of the LED based searchlight/sky light of the present disclosure.

With reference to the figures, the LED based searchlight/sky light of the present disclosure 100 includes, in a basic preferred embodiment, a frame/housing 116 and an LED array 102 supported in/or by frame/housing 116. LED array 102 is preferably in thermal communication with a heatsink 104 so as to dissipate heat generated by the operation of LED array 102. In a preferred arrangement, LED array 102 is secured to heatsink 104 such that heatsink 104 is supported in and/or by frame/housing 116 by a plurality of support arms 106. A reflector 122 is also supported in and/or by frame/housing 116. In a preferred arrangement, reflector 122 is a parabolic reflector 122 and LED array 102 is positioned above reflector 102 a distance sufficient such that light emitted from LED array 102 is directed toward reflector 122 and reflected by reflector 122 in an intense collimated beam of light. This intense collimated beam can be projected outwardly from searchlight/sky light 100 so as to attract attention of an observer a distance away for purposes such as advertising.

In an alternate embodiment, frame/housing 116 could be sealed by the installation of a piece of glass 118 which allows the collimated beam 128 to pass therethrough. Glass 118 is secured into frame/housing 116 by glass mount 120.

It is understood that glass 118 could be glass, plastic, polymer or other material suitable for this purpose. It is generally desirable to employ a light, strong, impact resistant material. In a preferred embodiment, glass 120 is constructed of polycarbonate, a light, extremely strong material, however, it is understood that glass 118 could be constructed of any suitable material.

The LED based searchlight/sky light 100 of the present disclosure employs at least one high flux LED and preferably a plurality of high flux LEDs arranged in an array. Suitable high flux LEDs may be obtained from LED engine in Santa Clara, Calif., which can provide up to 90 watts of LED light. In a preferred arrangement the combined output of the LED array 102 is at least approximately 350 watts and most preferably approximately 1,000 watts of LED light.

The LEDs can be clustered in an array 102 which could be in any suitable geometry. For example, without limitation, these LEDs can be clustered in a tight circular group of 12 mounted to a circuit board to form array 102 for a fixture that would provide approximately 1,000 watts of LED light. This example arrangement and light output equates to at least double the amount of light emitted than if a xenon bulb were employed while consuming the same power. In addition, LEDs emit no UV radiation and an extremely small amount of IR radiation. The LEDs comprising LED array 102 are preferably white but can, in an alternate embodiments, be replaced with red, green, or blue (RGB) LEDs. These bright RGB colors could be employed to provide a desired color effect in the projected beam of light without having to employ filters as with traditional light sources. However, it is understood, that colored filters could alternately be applied over glass 118 to also produce a colored effect.

Frame/housing 116 could include a frame structure which supports an outer solid, preferably opaque housing. Alternatively, frame/housing 116 could be constructed such that the outer, preferably opaque housing supports an internal frame structure. In yet another preferred embodiment, the outer, preferably opaque housing could be constructed strong enough such that itself serves as the frame without frame structure.

Heatsink 104, in an effort to assist in the dissipation of heat generated by LED array 102 is preferably secured to and supported from heatsink 104. In the preferred arrangement heatsink 104 is actively cooled through the use of a cooling mixture which is preferably a mixture of water and ethylene glycol. To accomplish this, heatsink 104 is essentially a manifold through which the cooling mixture is circulated. A pair of coolant hoses 108 and 114 are employed to circulate coolant to and from heatsink 104. Coolant may be circulated from heatsink 104 through coolant line 108 to a heat exchanger 110. Heat exchanger 110 could be any suitable structure, known in the art and may operate similar to a radiator or automotive heater core such that coolant which is heated as a result of circulation through heatsink/manifold 104 enters heat exchanger 110 and passes therethrough. Heat exchanger 110 may include fins for additional dissipation of heat through contact with surrounding air. For additional cooling, a suitable fan 109 such as a simple 12 volt muffin fan, for example, may be employed to move air across heatsink 110 to enhance the heat exchange capabilities. Once the coolant passes through heat exchanger 110 it is sufficiently cooled so as to be circulated back through coolant hose 114 into manifold/heatsink 104. Such circulation of coolant through heatsink 104 is continuous while searchlight/sky light 100 is in operation. A pump 112 may be employed to circulate coolant through this system. Pump 112 could be any suitable pump such as a 12 volt fluid pump known in the art.

In an alternate embodiment (not shown), heat tubes could be employed which extend from manifold/heatsink 104 to the outside of housing 116 which may then be in contact with a finned heat exchanger. In such an embodiment (not shown) the heat tubes would be oriented to allow for the convection of the coolant contained therein without the requirement of a powered pump to circulate the coolant.

Reflector 122 is mounted in and supported by frame/housing 116 such that its reflective surface is directed toward LED array 102. As stated, in a preferred arrangement, reflector 122 is a parabolic reflector which receives and reflects light photons emitted from LED array 102. Since LEDs are known to conduct heat as opposed to radiating heat, as is the case with carbonarc or xenon shortarc bulbs, reflector 122 of LED based searchlight/sky light 100 will not be subject to an intense radiation of heat. As a result, reflector 122 in the present disclosure can be constructed of lightweight, relatively inexpensive materials to which a reflective/mirror finish is applied. Any suitable mirror finish capable of receiving and reflecting light photons emitted from LED array 102 may be suitable.

LED array 102 is secured to heatsink 104. Heatsink 104 is supported within frame/housing 116 by supports 106 such that LED array 102 secured thereto is positioned above reflector 122. The LEDs in LED array 102 would preferably be constructed to include integral lenses so that they would each emit light in a 120° cone as shown in FIG. 1 as 126. LED array 102 is positioned above reflector 122 such that light photons emitted from the LEDs would impact parabolic reflector 122 such that they are reflected in an collimated orientation depicted in FIG. 1 as 128. As a result, in a preferred arrangement, LED array 102 is positioned above reflector 122 a distance sufficient such that light photons emitted from LED array 102 are reflected by reflector 122 to form an intense collimated beam. In a particularly preferred embodiment, LED array 102 is positioned above reflector 122 at the focal length of parabolic reflector 122.

LED array 102 and heatsink/manifold 104 may be sized and constructed so as to preferably not interfere with (block) the beam of collimated light reflected from parabolic reflector 122 past LED array 102 and heatsink/manifold 104 so as to exit housing 116 as shown in FIG. 1 as 128. By way of example only, and without limitation, it is contemplated that a housing 116 sized so as to receive a parabolic reflector having approximately a 3' diameter may be constructed with an LED array 102 positioned at its focal length wherein LED array 102 and heatsink 104 are sized approximately 2¼" by 2¼" with a thickness of approximately ½". As a result, an LED array 102 secured to a heatsink/manifold 104 of such an exemplary size and construction positioned above such a sized parabolic reflector 122 would cause very little obstruction of light projected from searchlight/sky light 100. However, it is understood that this is just an example and many different sizes are contemplated without departing from the scope of the present disclosure.

Power supply 124 produces roughly 48 volts at approximately 21 amps and is preferably a switch mode power supply operating to produce a substantially constant current to LED array 102. A dimmer operatively selects the level at which the constant current is supplied. Thus at full brightness, power supply 124 outputs approximately 21 amps, at half brightness 10.5 amps, etc. Power supply 124 also preferably accepts DMX-512 to set the output current. Alternatively, power supply 124 could output 48 volts at 21 amps and use variable duty cycle to control the brightness. Internet based controls could be employed to allow feedback regarding the internal conditions of the searchlight/sky light 100. Such feedback could be helpful to an operator at a remote location.

Light shaping diffusion (LSD), a holographic-type film can be applied over glass 118 of housing 116 in order to shape the light as desired. For example, the light emitted could be shaped to conform to an object such as a building. As a result, unwanted light spillage into the sky around the building could be avoided.

Figure 2:
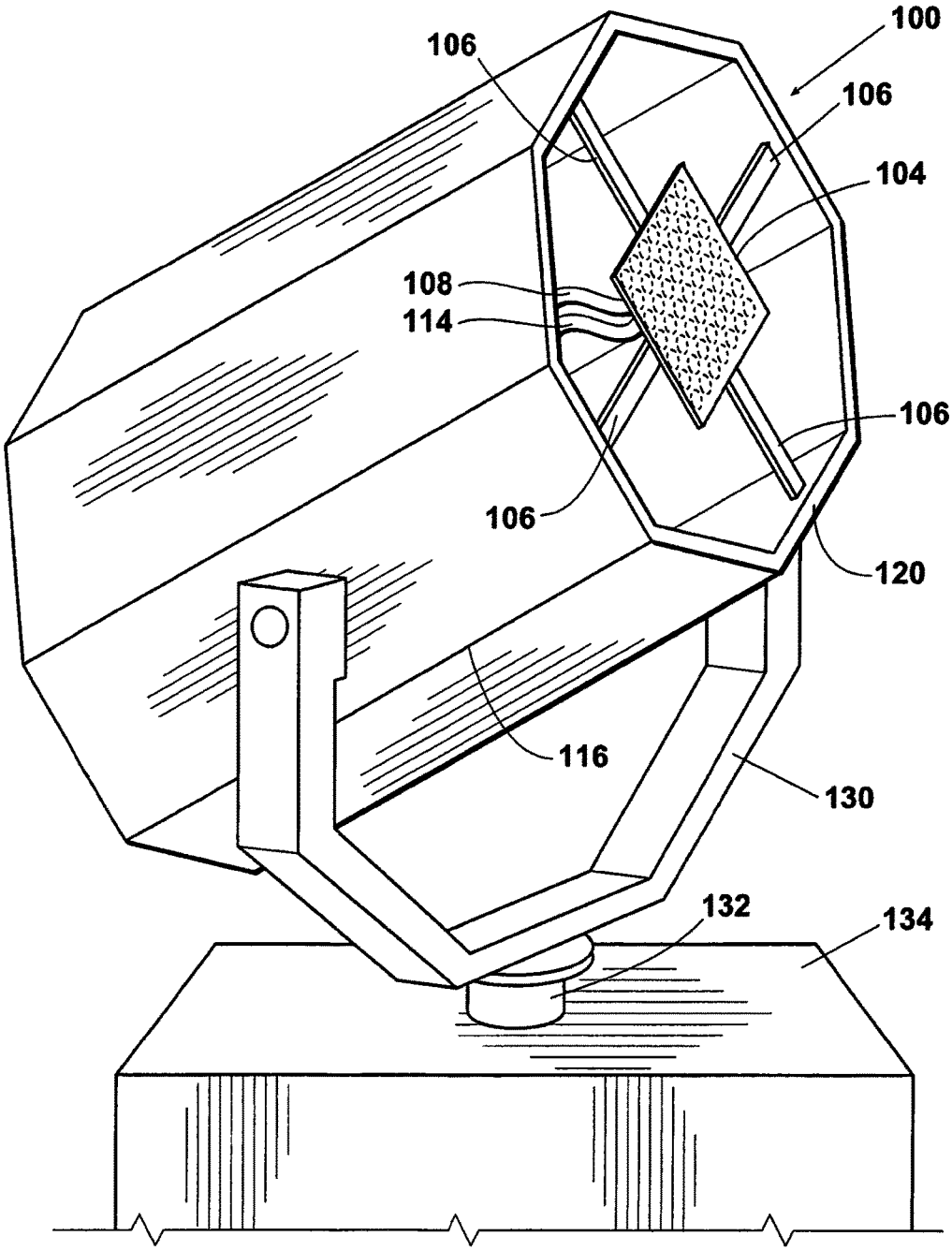
FIG. 2 is an isometric view of the LED based searchlight/sky light of the present disclosure moveably mounted to a base.
Figure 3:
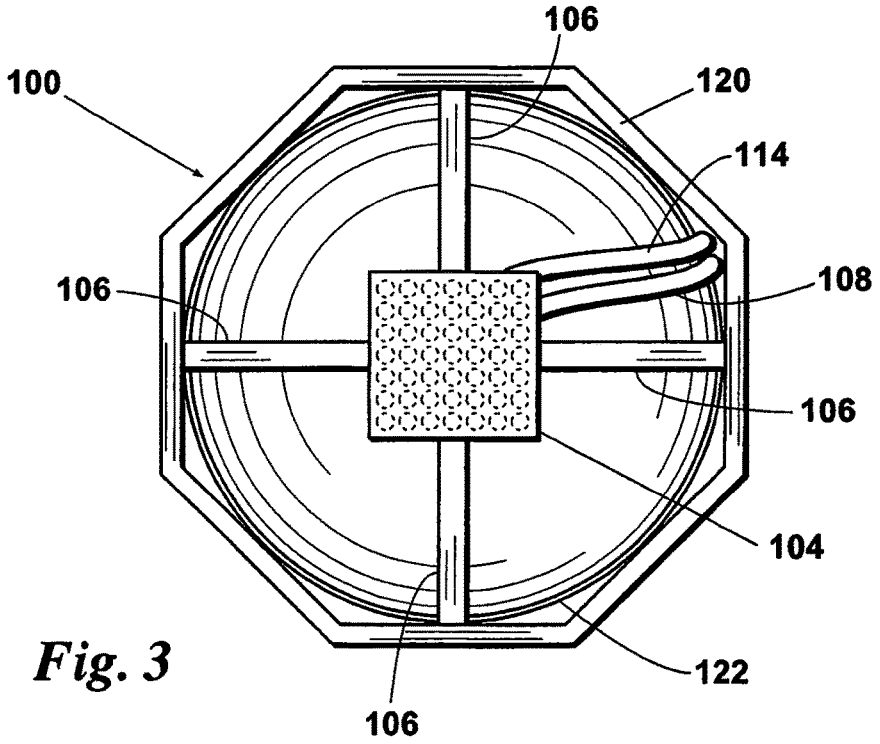
FIG. 3 is a top view of the LED based searchlight/sky light of the present disclosure.

With specific reference to FIG. 2, searchlight/sky light 100 is depicted as mounted to a base 134. Searchlight/sky light 100 could be mounted to base 134 using a known method such as a yoke 130 supported on a pin 132. In such an embodiment, pin 132 will allow yoke 130 to rotate in relation to base 134 in one axis and searchlight/sky light may be rotated within yoke 130 in relation to base 134 in another axis. As a result, searchlight/sky light 100 may be embodied so as to be moveable, either manually or remotely, with respect to base 134. In the event of remote operation, electric motors would be employed in a known manner so as to effectuate rotation of light 100 or yoke 130 with respect to base 134. Remote operation can be accomplished by such methods as DMX-512, wirelessly, or by an internet connection.

In alternate embodiments, a plurality of searchlights/sky lights 100 could be positioned adjacent each other. In such an embodiment the plurality of lights 100 could be operated, either manually or remotely, to produce a desired visual effect.

Figure 4:
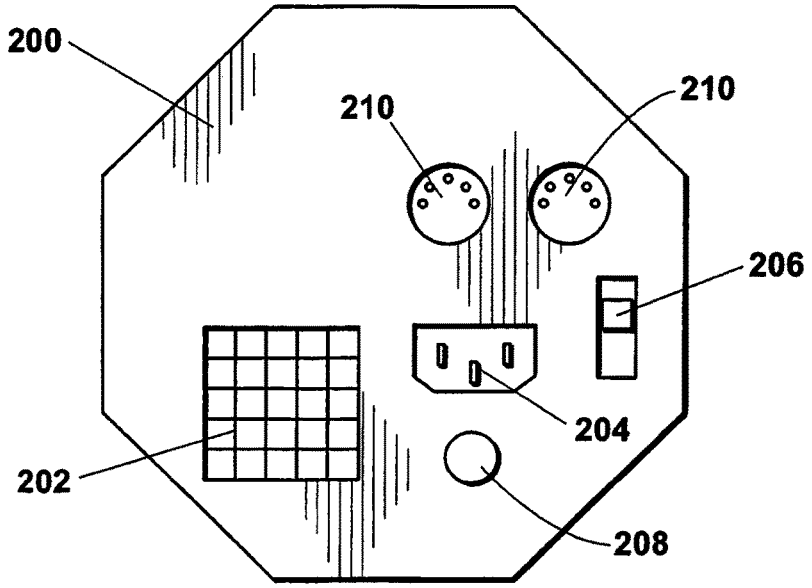
FIG. 4 is a bottom view of the LED based searchlight/sky light of the present disclosure.

With specific reference to FIG. 4, a bottom or rear panel 200 (depending on the orientation of light 100) is depicted. Rear panel 200 may include a vent 202 to allow the evacuation of air heated by its passage through heat exchanger 110 (FIG. 1). Rear panel 200 may also include a connector for electrical current such as a known IEC power connector 204 and may also include a power switch 206. A manual dimmer knob 208 may also be located on rear panel 200. Rear panel 200 may further include connectors such as DMX connectors 210 to provide for the remote control of searchlight/sky light 100.

A list of elements is depicted in the Figures, wherein:

100 LED based searchlight/sky light fixture assembly
102 LED array
104 water cooled heatsink
106 support arms
108 water line from heatsink
110 radiator
112 pump
114 water line to heatsink
116 fixture housing/frame
118 glass
120 glass mount
122 parabolic reflector
124 power supply
126 path of photon emitted by LED array
128 path of photon reflected by parabolic mirror reflector
122 130 yoke
132 pivot pin
134 base
200 rear panel
202 vent
204 electrical current connector
206 power switch
208 dimmer knob
210 DMX connectors Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A searchlight, comprising:
a frame;
an array of light emitting diodes capable of emitting at least 35,000 lumens of light upon application of electrical current;
said array of light emitting diodes being mounted to a heat sink;
said heat sink being liquid cooled and in conductive thermal communication with said array of light emitting diodes;
a heat exchanger in fluid communication with said heat sink;
a pump for circulating liquid coolant continuously between said heat sink and said heat exchanger in a closed system;
at least a 350 watt power supply configured for providing electrical current to said array of light emitting diodes and for regulating said electrical current applied to said array of light emitting diodes;
a reflector supported by said frame such that said at least one LED is capable of being positioned with respect to said reflector such that a majority of said light emitted from said array of light emitting diodes is directed toward said reflector is reflected by said reflector to produce a projected beam of light;
wherein said beam of light has a beam angle less than 70 degrees.

2. The searchlight of claim 1 wherein said reflector is a frusto-parabolic reflector.

3. The searchlight of claim 1 wherein said array of light emitting diodes is positioned above said reflector at the focal length of said reflector.

4. The searchlight of claim 1 wherein said heatsink includes a manifold containing said liquid coolant therein in fluid communication with said heat exchanger.

5. The searchlight of claim 1 wherein said power supply is capable of selectively dimming said array of light emitting diodes.

6. The searchlight of claim 1 wherein said array of light emitting diodes has a cumulative wattage of at least approximately 350 watts.

7. A luminaire for the projection of an intense beam of light, comprising:
a housing having an interior;
an LED array capable of emitting at least 35,000 lumens of light upon application of electric current;
a liquid cooled heat sink in conductive thermal communication with said LED array;
a heat exchanger in fluid communication with said heat sink;
a pump for circulating liquid continuously between said heat sink and said heat exchanger supported in said housing;
a frusto-parabolic reflector supported in said housing;
said LED array being positioned with respect to said frusto-parabolic reflector at substantially the focal length of said parabolic reflector and such that at least 65% of said light emitted from said LED array is directed toward said reflector and is reflected by said reflector to project the intense beam of light.

8. The searchlight/sky light of claim 7 wherein said LED array is positioned in said housing such that light emitted from said LED array directed toward said frusto-parabolic reflector is reflected in a collimated beam.

9. The luminaire of claim 7 further including a remotely controllable power supply of at least 350 watts for regulating the electric current applied to said LED array.

10. The luminaire of claim 9 wherein said LED array is dimmable by controlling said power supply to vary the electric current applied to said LED array.

11. The luminaire of claim 7 wherein said heatsink includes a manifold capable of containing a liquid coolant and is in fluid communication with at least one heat exchanger.

12. The luminaire of claim 11 wherein a fan is capable of moving air across said heat exchanger.

13. The luminaire of claim 7 wherein said LED array is comprised of high flux LEDs.

14. The luminaire of claim 8 wherein said housing is mounted to a base such that said housing is movable with respect to said base in order to vary the direction of said collimated beam.

15. The luminaire of claim 14 wherein the movement of said housing with respect to said base is controlled remotely.

16. The luminaire of claim 7 further comprising a polycarbonate cover secured to said housing.

17. The luminaire of claim 7 further comprising a glass cover secured to said housing.

18. The luminaire of claim 9 wherein said at least a 350 watt power supply is a switch mode power supply.

19. The luminaire of claim 9 further comprising a fan for moving air across said heat exchanger.

20. The luminaire of claim 7 wherein said heat exchanger is physically removed from said heat sink.

* * * * *